US008360681B1

(12) United States Patent
Hébert

(10) Patent No.: US 8,360,681 B1
(45) Date of Patent: Jan. 29, 2013

(54) PORTABLE CONCRETE STRIKING DEVICE WITH AUGER

(75) Inventor: Paul Hébert, Laval (CA)

(73) Assignee: 9168-8168 Quebec Inc. (CA)

( * ) Notice: Subject to any disclaimer, the term of this patent is extended or adjusted under 35 U.S.C. 154(b) by 0 days.

(21) Appl. No.: 13/212,706

(22) Filed: Aug. 18, 2011

(51) Int. Cl.
*E01C 19/15* (2006.01)

(52) U.S. Cl. ..... 404/114; 404/118

(58) Field of Classification Search ..... 404/114, 404/118, 120
See application file for complete search history.

(56) References Cited

U.S. PATENT DOCUMENTS

| | | | | |
|---|---|---|---|---|
| 4,386,901 | A | 6/1983 | Morrison | |
| 5,129,803 | A | 7/1992 | Nomura et al. | |
| 5,375,942 | A | 12/1994 | Lindley et al. | |
| 6,953,304 | B2 * | 10/2005 | Quenzi et al. | 404/114 |
| 6,976,805 | B2 * | 12/2005 | Quenzi et al. | 404/114 |
| 7,108,450 | B2 * | 9/2006 | Grubba | 404/84.5 |
| 7,121,762 | B2 * | 10/2006 | Quenzi et al. | 404/84.1 |
| 7,320,558 | B2 * | 1/2008 | Quenzi et al. | 404/75 |
| 7,407,339 | B2 * | 8/2008 | Halonen et al. | 404/118 |
| 7,491,011 | B2 * | 2/2009 | Quenzi et al. | 404/84.1 |

FOREIGN PATENT DOCUMENTS

| | | |
|---|---|---|
| CA | 853607 | 10/1970 |
| CA | 1281201 | 3/1991 |

* cited by examiner

*Primary Examiner* — Gary S Hartmann
(74) *Attorney, Agent, or Firm* — Bourque and Associates, PA

(57) ABSTRACT

The portable concrete striking device comprises an elongated portable screed, a handle mounted to the screed for allowing a worker to manually pull the screed towards an upstream direction and an auger rotatably mounted to the screed and located upstream of the screed. A motor is linked to the auger for rotating the auger. The auger is capable of directing excess concrete upstream of the screed towards an excess concrete discharge location which is located at a determined position along the elongated screed.

15 Claims, 7 Drawing Sheets

PORTABLE CONCRETE STRIKING DEVICE WITH AUGER

FIELD OF THE INVENTION

The invention relates to portable concrete striking devices and more particularly to a portable concrete striking device with an auger that allows the soft upstream excess concrete to be channelled and discharged at a selected location.

BACKGROUND OF THE INVENTION

Some known portable concrete striking devices are of the type comprising a screed for striking a soft concrete surface, which includes concurrently flattening the concrete and levelling it. The screed is pulled along the concrete surface by means of handles attached to the screed. A vibration inducing device is also attached to the screed for inducing vibrations in the screed. A worker will pull the portable screed along the uneven surface of the fresh, soft concrete which has just been poured. The vibrating screed helps level the concrete to obtain an even surface before the concrete sets.

One of the advantageous characteristics of the concrete is that it has a rather good resistance to wear. However, excessive vibrations induced in the concrete can cause cement particles to rise towards the concrete upper surface, thus effectively reducing its resistance to wear. This is of course a highly undesirable side effect when striking a concrete surface with a vibrating screed.

Another problem with portable screeds relates to upstream excess concrete shovelling. Indeed, as the screed is pulled along the soft concrete surface to level it, concrete will accumulate unevenly to form mounds at variable locations upstream of the screed, forcing the removal of this excess concrete to avoid impeding the advance of the screed. This is problematic since in the case of portable screeds the worker pulling on the screed becomes incapable of pulling on the screed if there is too much concrete upstream of the screed. To avoid this problem, at least one other worker will cooperate with the worker pulling the portable striking device, this other worker shovelling the excess concrete upstream of the screed and especially at the variable locations along and near the screed where the concrete accumulates in larger mounds. These mounds are often partly created by the screed itself as the excess concrete which is not being struck will be pushed by the screed to form these mounds. The shovelling worker will move from one side to the other of the screed to address concrete accumulation where it exists near and upstream of the screed, including moving around the screed-pulling worker. This results in the shovelling worker often hindering the screed-pulling worker and forcing the screed-pulling worker to temporarily stop his otherwise preferably steady advance with the screed. Furthermore, the advance of the screed also needs to be temporarily stopped if the excess concrete volume is too important to allow the upstream excess concrete to be addressed. This is impractical.

SUMMARY OF THE INVENTION

The present invention relates to a portable concrete striking device comprising:

- an elongated portable screed defining opposite first and second ends;
- a handle member mounted to said screed for allowing a worker to manually pull the screed towards an upstream direction;

- an auger rotatably mounted to said screed and located upstream of said screed; and
- a motor mounted to one of said screed and said handle member and operatively linked to said auger for rotating said auger;

wherein said auger is capable of directing excess concrete upstream of said screed towards an excess concrete discharge location which is located at a determined position along said elongated screed.

In one embodiment, said elongated screed is cross-sectionally generally L-shaped and comprises a blade for flatly engaging the concrete being struck and a concrete push wall integrally linked to said blade and transversely upstanding therefrom.

In one embodiment, said blade and said concrete push wall are at a right angle with respect to one another.

In one embodiment, said excess concrete discharge location is located at one of said first and second ends.

In one embodiment, said portable screed comprises an excess concrete evacuation mechanism at said excess concrete discharge location for evacuating excess concrete away from said screed and said auger.

In one embodiment, said excess concrete evacuation mechanism comprises an excess concrete discharge opening in said screed at said excess concrete discharge location, with said auger extending partly upstream of said excess concrete discharge opening.

In one embodiment, said excess concrete discharge opening is made in both said blade and said concrete push wall.

In one embodiment, said concrete push wall has a portion that extends over said excess concrete discharge opening.

In one embodiment, said excess concrete discharge location is located in-between and spaced from said first and second ends.

In one embodiment, said excess concrete discharge location is located centrally between said first and second ends.

In one embodiment, said excess concrete evacuation mechanism comprises a transverse concrete conveyor carried by one of said screed and said handle member and located at said excess concrete discharge location for conveying excess concrete transversely upstream and away from said auger.

In one embodiment, said transverse concrete conveyor comprises a powered rotatable screw member disposed transversely to said auger for conveying the concrete transversely upstream and away from said auger.

In one embodiment, said rotatable screw member is carried by said auger and is operatively connected to a shaft of said auger to be rotated concurrently with said auger.

In one embodiment, the portable concrete striking device further comprises a level device mounted to said screed.

In one embodiment, said level device includes laser captors for cooperation with an outboard laser level for striking the concrete surface at a desired angle.

DETAILED DESCRIPTION OF THE EMBODIMENTS

Figure 1:
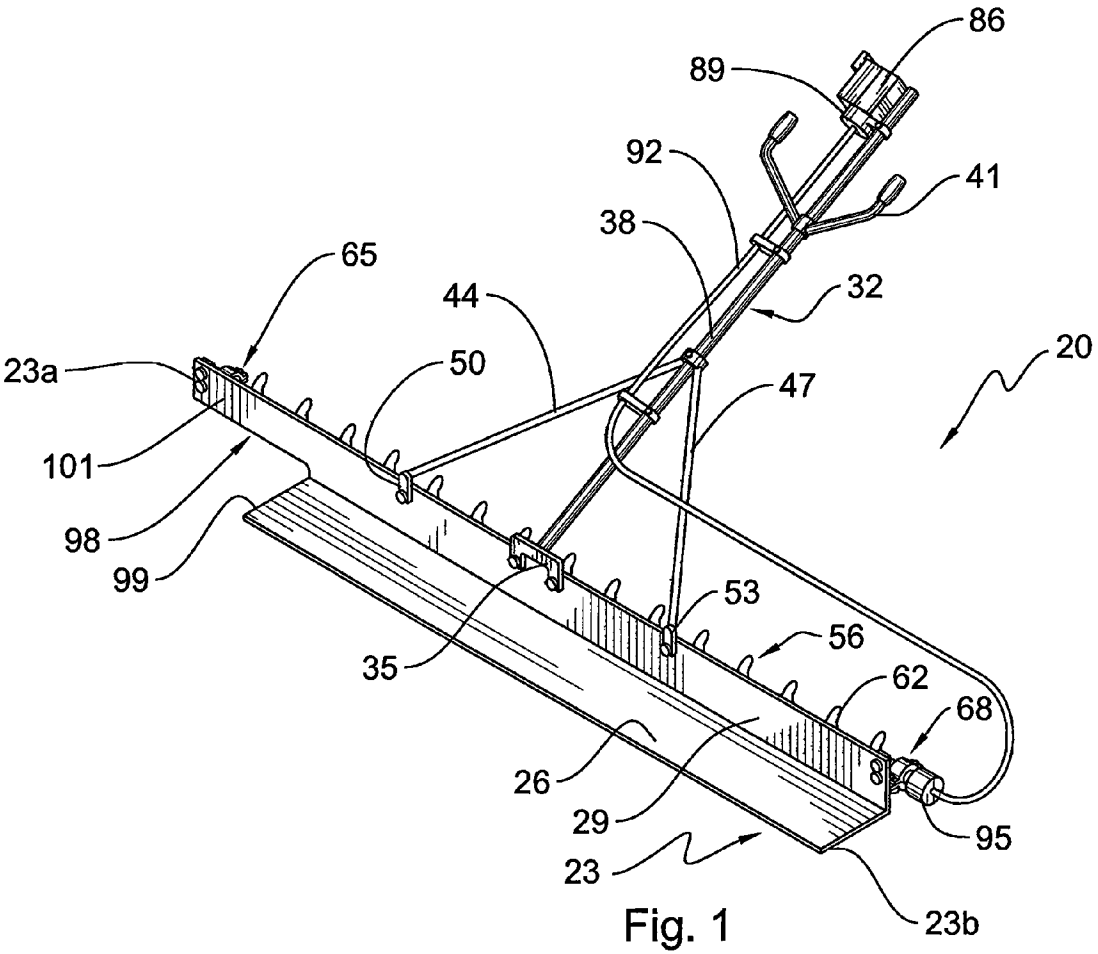
FIG. 1 is a front perspective view of a portable concrete striking device according to a first embodiment of the present invention.

FIGS. 1-4 shows a portable concrete striking device 20 according to the present invention which is used to strike a soft concrete surface before the concrete sets. Portable concrete striking device 20 is said to be portable in that it can be manually pulled by a single worker over concrete, as opposed to requiring a vehicle to carry or move it.

Portable concrete striking device 20 comprises an elongated portable screed 23 defining opposite first and second ends 23*a*, 23*b*. Screed 23 is cross-sectionally generally L-shaped and comprises a blade 26 for flatly engaging the concrete being levelled and a concrete push wall 29 integrally linked to blade 26 and transversely upstanding therefrom. Blade 26 and concrete push wall 29 are perpendicular, although they could optionally be at a different angle as long as push wall 29 remains generally transverse to blade 26.

Portable concrete striking device 20 also comprises a handle member 32 fixedly attached to screed 23 and more particularly attached to concrete push wall 29 midway between screed first and second ends 23*a*, 23*b* with a handle member bracket 35. Handle member 32 comprises an elongated support rod 38 to which handlebars 41 are mounted distally from screed 23 for allowing a worker to manually pull the screed towards an upstream direction where concrete needs to be struck. Reinforcement rods 44, 47 link support rod 38 to screed push wall 29 by means of reinforcement rod brackets 50, 53.

Figure 4:
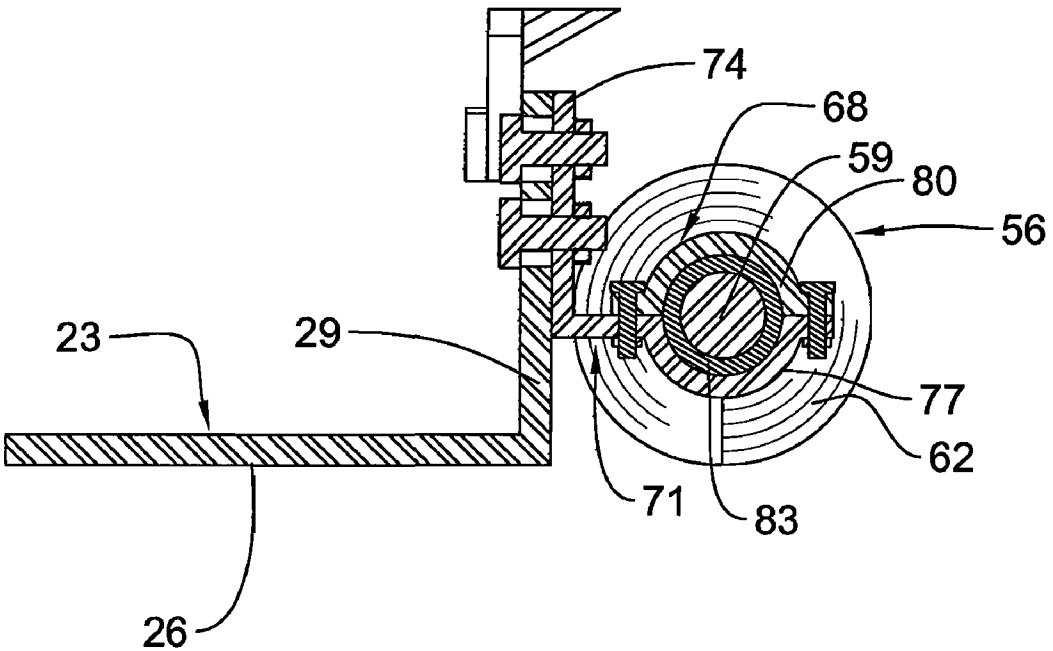
FIG. 4 is a cross-sectional view, at an enlarged scale, taken along line IV-IV of FIG. 3.

Portable concrete striking device 20 further comprises an auger 56 rotatably mounted to screed 23 and located upstream of screed 23. More particularly, auger 56 comprises a rotating shaft 59 equipped with a helical blade 62. Auger shaft 59 is rotatably mounted to screed 23 at its first and second ends 23*a*, 23*b* by shaft supports 65, 68. Each shaft support 65, 68, for example shaft support 68 as shown in FIG. 4, comprises an elbowed support bar 71 having a first attachment section 74 bolted to concrete push wall 29 and a second cradle section 77 extending upstream and away from concrete push wall 29. Shaft support 68 also has a cradle top bar 80 bolted to cradle section 77 to form a hollow cylindrical cradle through which shaft 59 extends and within which shaft 59 can rotate. A low-friction brass ring 83 is interposed between the cradle and shaft 59 to reduced friction.

Figure 2:
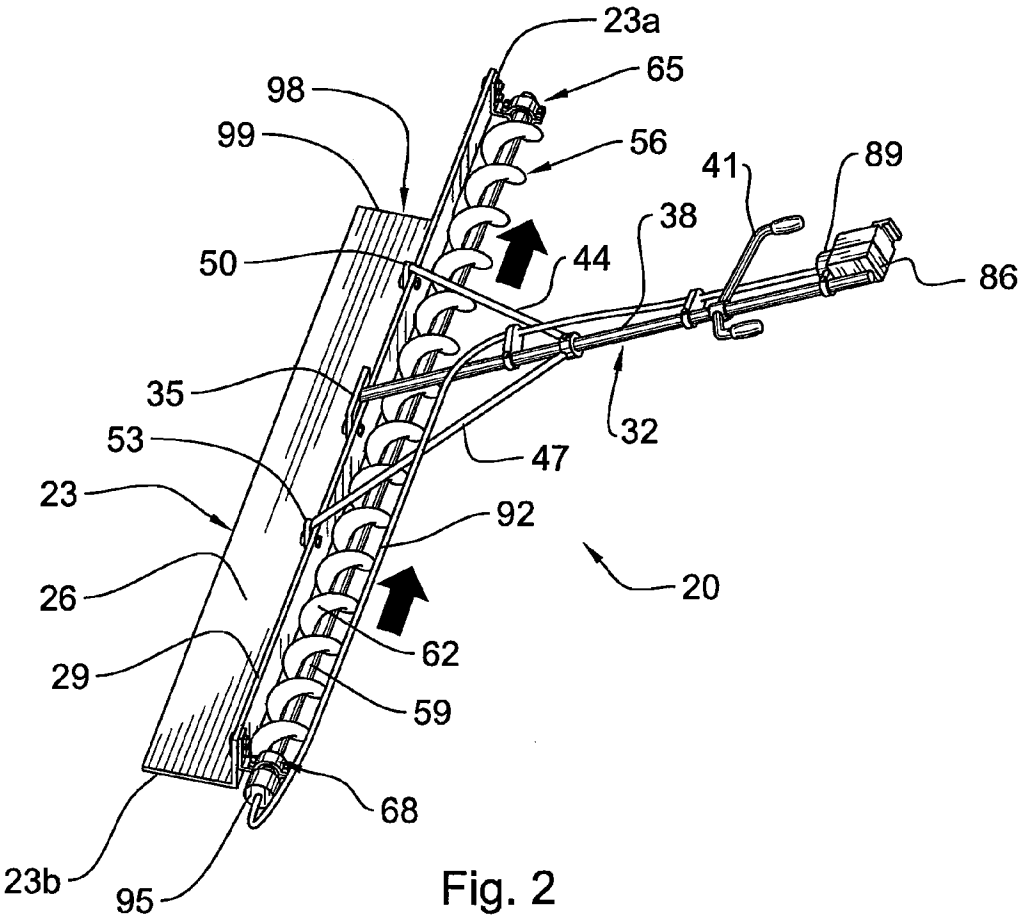
FIGS. 2 and 3 are respectively a rear perspective view and a front elevation of the portable concrete striking device of FIG. 1, with arrows suggesting the direction in which the excess concrete will flow towards the excess concrete discharge location.
Figure 3:
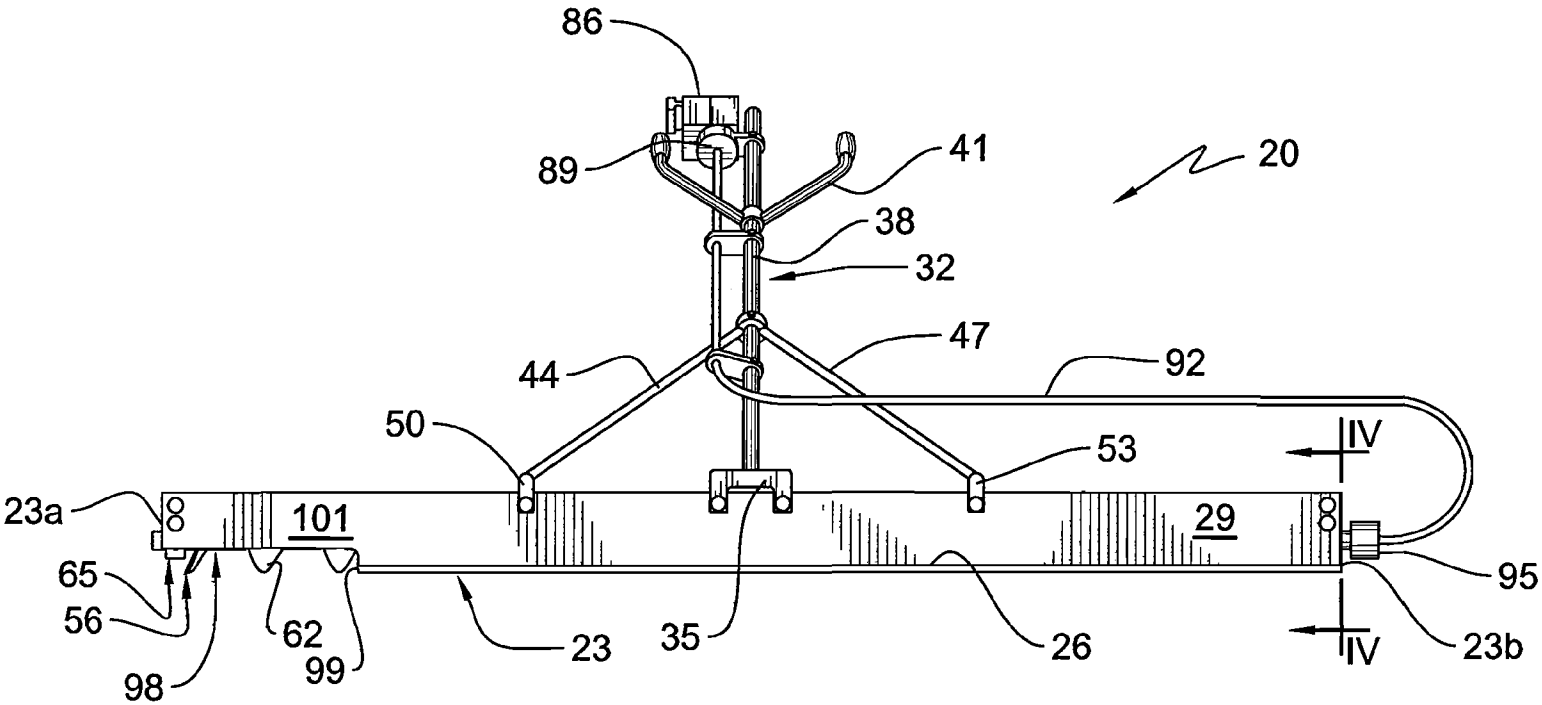

FIGS. 1-3 show that concrete striking device 20 further comprises a motor 86 mounted to handle member 32 and more particularly to support rod 38 by means of a motor bracket 89. Motor 86 is installed at the end of handle member support rod 38 opposite screed 23, beyond handlebar 41. Motor 86 may be powered with any portable power supply, e.g. it may be battery or fuel-powered. A flexible shaft 92 links motor 86 to auger 56 through the instrumentality of a gearbox 95 wherein suitable gears intermesh to provide a desired transmission of the rotating flexible shaft movement to auger shaft 59, to rotate auger 56. Motor 86 is provided with suitable controls (not shown) to allow a worker to selectively activate it.

The helical blade 62 of auger 56 is pitched such that when the auger rotates in a determined direction, granular material such as concrete will be directed towards an excess concrete discharge location of screed 23 which is located near screed first end 23*a*. Screed 23 comprises an excess concrete evacuation mechanism in the form of an excess concrete discharge opening 98 at its excess concrete discharge location which helps evacuate the excess concrete upstream of screed 23. Opening 98 is made both in screed blade 26 and in screed concrete push wall 29. More particularly, blade 26 is cut at 99 to extend short of screed first end 23*a* to partly define excess concrete discharge opening 98, while concrete push wall 29 is cut-away in register with the cut-away portion made in blade 26 to partly define excess concrete discharge opening 98. A portion 101 of concrete push wall 29 extends all the way to screed first end 23*a* over excess concrete discharge opening 98.

In use, a screed-pulling worker will activate motor 86 to rotate auger 56 and will then pull screed 23 along the ground by using handlebar 41. In doing so, screed blade 26 will strike the concrete while concrete push wall 29 will prevent excess concrete from flowing over blade 26, in effect pushing the excess concrete not being struck and located upstream of push wall 29. The rotating auger 56 will convey this excess concrete towards the excess concrete discharge location, namely towards screed first end 23*a*. The excess concrete is then discharged through excess concrete discharge opening 98 and/or laterally beyond screed first end 23*a* to form a generally linear mound. The fact that auger 56 extends in front of excess concrete discharge opening 98 contributes to create the excess concrete evacuation mechanism that will evacuate the concrete away from the screed upstream location.

A shovelling worker who cooperates with the screed-pulling worker may shovel the concrete by standing next to screed 23 to remove the excess concrete mound and spread it more evenly across the area where the concrete has not yet been struck, or otherwise transport it to a desired location.

Figure 5:
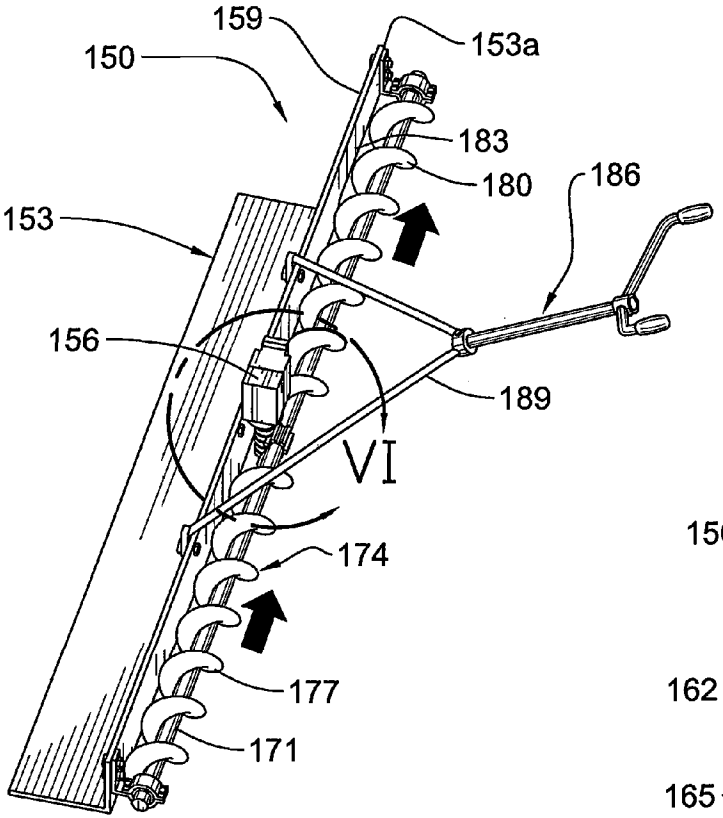
FIG. 5 is a rear perspective view of a portable concrete striking device according to a second embodiment of the present invention, with arrows suggesting the direction in which the excess concrete will flow towards the excess concrete discharge location.
Figure 6:
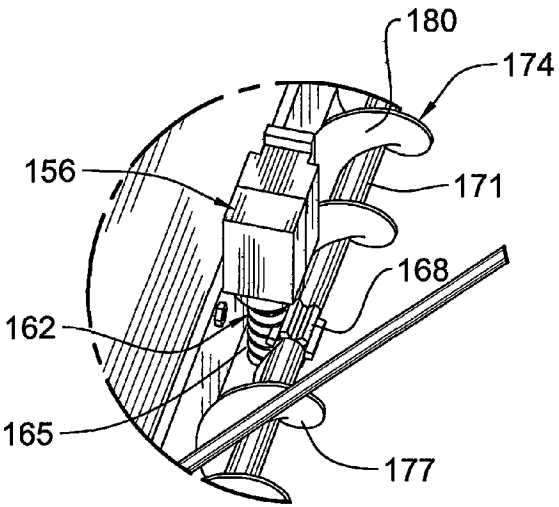
FIG. 6 is an enlarged view of the area circumscribed by circle VI of FIG. 5.

FIGS. 5 and 6 show a concrete striking device 150 according to a second embodiment of the invention, which is similar to concrete striking device 20 of the first embodiment except as noted hereinafter.

Concrete striking device 150 has a screed 153 and a motor 156 mounted directly atop screed 153, more particularly fixed to upright concrete push wall 159. Motor 156 has a rigid shaft 162 that is threaded at 165 to engage a geared portion 168 of the shaft 171 of auger 174. Auger 174 is provided with a pair of helical blades 177, 180 that have a same pitch and that are inclined in a same direction. Both helical blades consequently convey the concrete towards the excess concrete discharge opening 183 and/or beyond the screed first end 153*a*, at the excess concrete discharge position of screed 153. Handle member 186 is attached to screed 153 by means of Y-shaped attachment bars 189 that allow motor 156 to be located centrally on screed 153.

This position of motor 156 allows a rigid shaft to be used as opposed to the flexible shaft of the first embodiment; and also allows for the installation of motor 156 directly on screed 153 as opposed to installing it on the handle member, which is less heavy for the screed-pulling worker.

As noted above, concrete being conveyed by auger 174 will be directed by the two helical blades towards excess concrete discharge opening 183 and/or beyond screed first end 153*a*, some of the concrete passing through the motor shaft-auger link 165-168 along the way. More particularly, concrete conveyed by the first helical blade 177 will be conveyed towards motor 156, where the concrete will be pushed towards second helical blade 180 by the upcoming concrete, to finally be conveyed by helical blade 180 towards excess concrete discharge opening 183. Both helical blades 177, 180 have a same pitch to provide a steady, regular concrete conveyance towards excess concrete discharge opening 183 all along screed 153.

Figure 7:
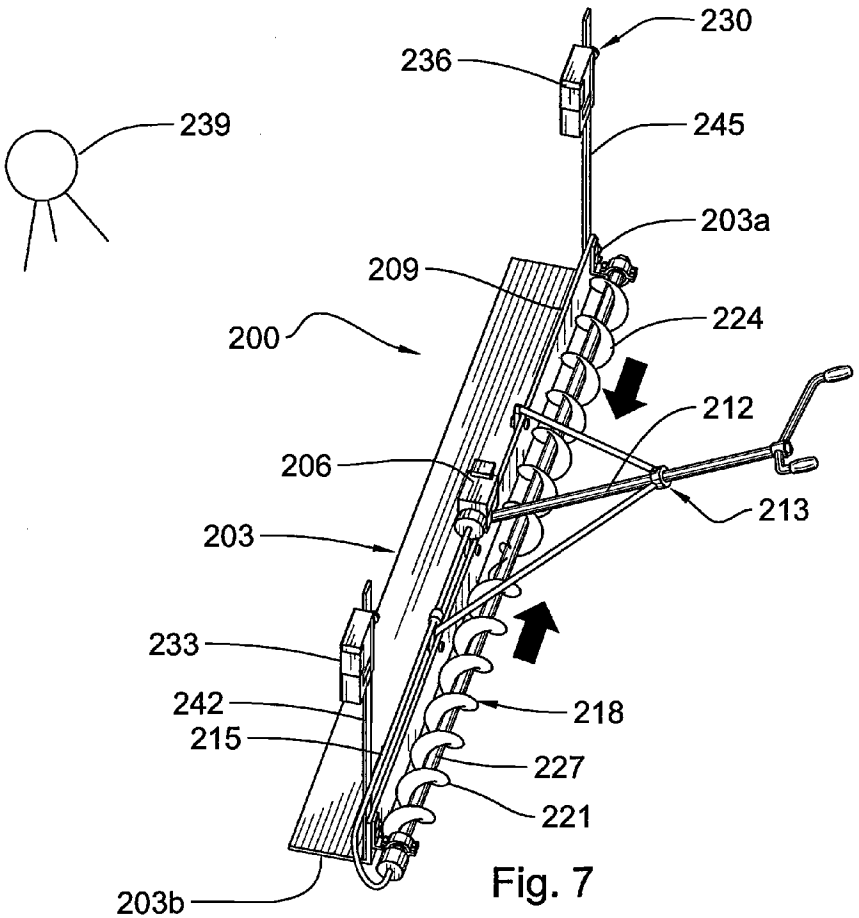
FIG. 7 is a rear perspective view of a portable concrete striking device according to a third embodiment of the present invention, together with an outboard laser level, with arrows suggesting the direction in which the excess concrete will flow towards the excess concrete discharge location.

FIG. 7 shows a concrete striking device 200 according to a third embodiment, which is similar to concrete striking devices 20 and 150 of the first and second embodiments except as noted hereinafter.

Concrete striking device 200 comprises a screed 203 and a motor 206 mounted directly atop screed 203 and more particularly on the concrete push wall 209. The support rod 212 of the handle member 213 extends from push wall 209 underneath motor 206. A flexible shaft 215 links motor 206 to an auger 218 mounted to screed 203. In this embodiment, the motor is consequently supported by the screed but a flexible shaft is used nonetheless.

Auger 218 comprises a pair of helical blades 221, 224 mounted to an auger shaft 227. Helical blades 221 and 224 are each inclined in opposite directions to convey concrete towards an excess concrete discharge location located in-between and spaced from the first and second ends 203*a*, 203*b* of screed 203. More particularly, each one of helical blades 221, 224 extends from one end of shaft 227 to its midpoint, and the excess concrete discharge location is consequently located centrally between the screed first and second ends 203*a*, 203*b* where blades 221, 224 meet. Excess concrete can consequently be conveyed towards the excess concrete discharge location which is centrally located along screed 203, where it may be shovelled by the shovelling worker to be spread across the ground where the concrete has not been struck. If the handle member 213 is long enough, the screed-pulling worker will not hinder the shovelling worker during the process. As with the two first embodiments, the position of the excess concrete is predictable due to it being conveyed by auger 218 and can consequently easily be dispatched by the shovelling worker.

It is noted that screed 203 according to this third embodiment comprises no excess concrete discharge opening since all concrete is directed towards the center of screed 203 where it will be shovelled away.

This embodiment is useful if no shovelling worker is present. In such a case, the screed-pulling worker may pull on the screed and stop to shovel excess concrete when it has accumulated in sufficient quantities, this excess concrete being literally at his feet centrally along screed 203.

Concrete striking device 200 further comprises a level device 230 mounted to screed 203. More particularly, level device 230 includes laser captors 233, 236 for cooperation with an outboard laser level 239, all of known constructions, for striking the concrete surface at a desired angle, normally horizontally. Laser captors are mounted at an adjustable height to laser captor support rods 242, 245 that are in turn attached to screed 203 at the first and second ends 203*a*, 203*b* thereof.

Figures 8, 9:
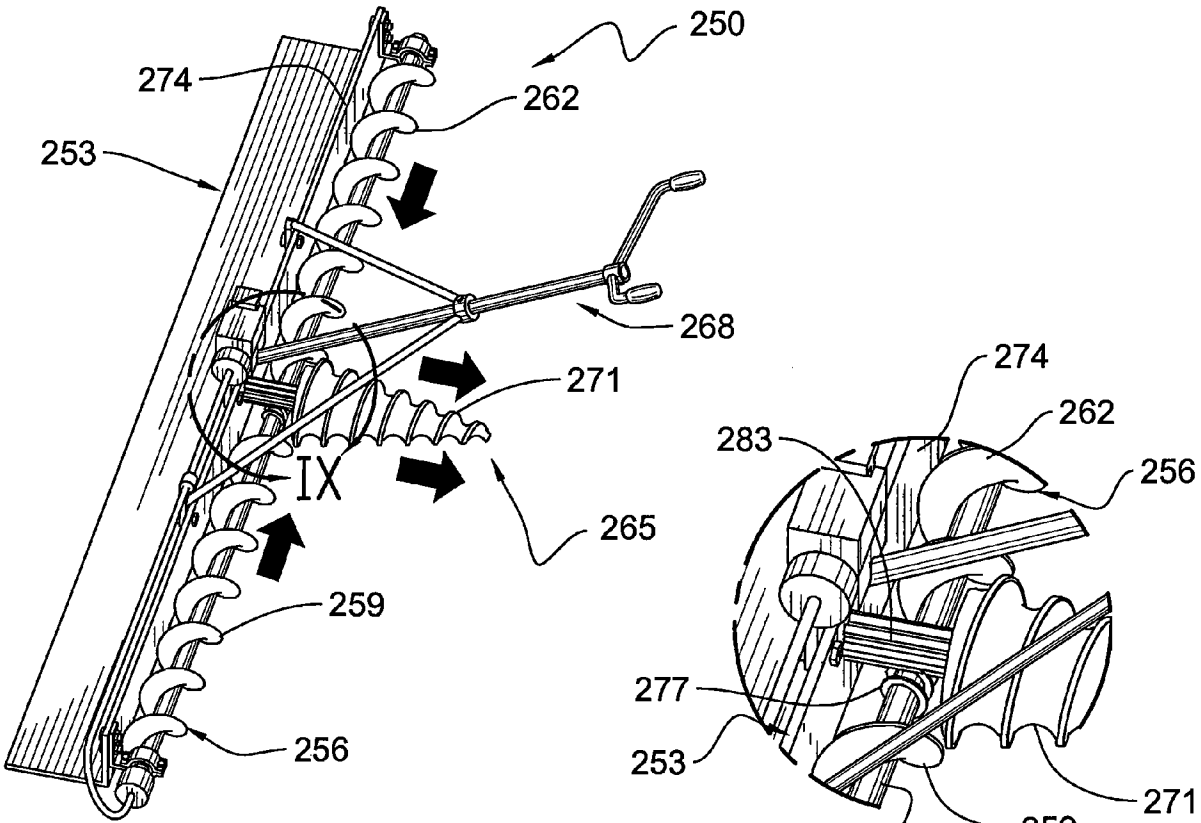
FIG. 8 is a rear perspective view of a portable concrete striking device according to a fourth embodiment of the present invention, with arrows suggesting the direction in which the excess concrete will flow towards the excess concrete discharge location.
FIG. 9 is an enlarged view of the area circumscribed by circle IX of FIG. 8.

FIGS. 8 and 9 show a concrete striking device 250 according to a fourth embodiment of the invention, which is similar to concrete striking devices 20, 150 and 200 of the first three embodiments except as noted hereinafter.

Concrete striking device 250 is especially similar to concrete striking device 100 of the third embodiment, in that it comprises a screed 253 carrying an auger 256 having a pair of helical blades 259, 262 that have opposite inclinations to convey the concrete towards an excess concrete discharge location which is located centrally along screed 253. In this fourth embodiment, concrete striking device 250 comprises a transverse concrete conveyor 265 carried by screed 253 at the excess concrete discharge location, although it could alternately be carried by handle member 268.

More particularly, transverse concrete conveyor 265 comprises an excess concrete evacuation mechanism that includes the combination of the helical blades pitch orientation with a powered rotatable conical transverse screw member 271 disposed transversely to auger 256 and centrally thereof for conveying the concrete transversely upstream and away from auger 256. Indeed, as concrete will be conveyed towards the excess concrete discharge position, it will engage transverse screw member 271 to be conveyed upstream and away from auger 256. The shovelling worker (or the screed-pulling worker if there is no shovelling worker) can consequently shovel the concrete along and upstream of transverse screw member 271, essentially at a single location along screed 253, to spread it across the surface to be struck.

Transverse screw member 271 helps avoid accumulation of concrete near and against the screed concrete push wall 274, which would hinder the advancement of screed 253.

Transverse screw member 271 is rotated by means of a thread 277 provided on shaft 280 of auger 256 operatively engaging a geared shaft 283 of transverse screw member 271, with geared shaft 283 being rotatably mounted to concrete push wall 274. Transverse screw member 271 is consequently rotated concurrently with auger 256.

One advantage of the portable concrete striking device of all embodiments of the present invention is consequently that it allows the excess concrete upstream of the screed to be conveyed towards an excess concrete discharge location which is located at a determined position along the elongated screed. The excess concrete may consequently be addressed at this position by a shovelling worker. This advantage is very important in the case of a portable concrete striking device because (1) the screed-pulling worker will not be capable of pulling the screed if excessive concrete accumulates upstream of the screed, so facilitating the excess concrete removal helps prevent this problem; (2) the shovelling worker will not have to continuously move about the screed-pulling worker during the striking process since the excess concrete will be removed at a single, predictable location; and (3) it is much easier to shovel and handle excess concrete if it is concentrated at a single location than having to address smaller mounds of concrete unevenly spread upstream of the screed.

Another advantage of the present invention is that the auger helps manually pull the screed by preventing excess concrete accumulation from bearing against the vertical concrete push wall and hindering the screed advance.

It is noted that the above advantages relate to use of an auger to convey excess concrete towards a determined screed excess concrete discharge location specifically on a portable concrete striking device.

The invention claimed is:

1. A portable concrete striking device capable of being manually pulled without a motorized device, and capable of being carried by a worker comprising:

an elongated portable screed defining opposite first and second ends, wherein said elongated portable screed is cross-sectionally generally L-shaped and comprises a blade for flatly engaging concrete being struck and a concrete push wall integrally linked to said blade and transversely upstanding therefrom;

a handle member, mounted to said elongated portable screed, and configured for allowing the worker to manually pull the screed in an upstream direction;

an elongated auger, rotatably mounted to said screed and extending at least from said first to said second ends of said elongated portable screed, and located upstream of said screed when said portable concrete striking device is in use and being manually pulled; and a motor, mounted to one of said screed and said handle member, and operatively linked to said auger, and configured for rotating said auger;

wherein said portable concrete levelling device is adapted to rest directly on concrete being levelled with said screed without support from a wheeled support structure, and wherein said auger is configured for directing excess concrete upstream of said screed towards an excess concrete discharge location which is located at a predetermined position along said elongated screed proximate one of said first and second opposite ends, wherein said portable screed comprises an excess concrete evacuation mechanism at said excess concrete discharge location for evacuating excess concrete away from said screed of said auger and wherein said excess concrete evacuation mechanism comprises an excess concrete discharge opening in said screed at said excess concrete discharge location, with said auger extending partly upstream of said excess concrete discharge opening.

2. A portable concrete striking device as defined in claim 1, wherein said blade and said concrete push wall are at a right angle with respect to one another.

3. A portable concrete striking device as defined in claim 1, wherein said excess concrete discharge location is located at one of said first and second ends.

4. A portable concrete striking device as defined in claim 1, wherein said excess concrete discharge opening is made in both said blade and said concrete push wall.

5. A portable concrete striking device as defined in claim 4, wherein said concrete push wall has a portion that extends over said excess concrete discharge opening.

6. A portable concrete striking device as defined in claim 5, wherein said excess concrete discharge location is located at one of said first and second ends.

7. A portable concrete striking device as defined in claim 1, wherein said excess concrete discharge location is located in-between and spaced from said first and second ends.

8. A portable concrete striking device as defined in claim 7, wherein said excess concrete discharge location is located centrally between said first and second ends.

9. A portable concrete striking device as defined in claim 1, further comprising a level device mounted to said screed.

10. A portable concrete striking device as defined in claim 9, wherein said level device includes laser captors for cooperation with an outboard laser level for striking the concrete surface at a desired angle.

11. A portable concrete striking device capable of being manually pulled without a motorized device, and capable of being carried by a worker comprising:

an elongated portable screed defining opposite first and second ends, wherein elongated portable screed cross-sectionally generally L-shaped and comprises a blade for flatly engaging concrete being struck and a concrete push wall integrally said blade and transversely upstanding therefrom;

a handle member, mounted to said elongated portable screed, and configured for allowing the worker to manually pull the screed in an upstream direction;

an elongated auger, rotatably mounted to said screed and extending at least from said first to said second ends of said elongated portable screed, and located upstream of said screed when said portable concrete striking device is in use and being manually pulled; and a motor, mounted to one of said screed and said handle member, and linked to said auger, and configured for rotating said auger;

wherein said portable concrete levelling device is adapted to rest directly on concrete being leveled with said screed without support from a wheeled support structure, and wherein said auger is configured for directing excess concrete upstream of said screed towards an excess concrete discharge location which is located at a predetermined position along said elongated screed proximate one of said first and second opposite ends, wherein said portable screed comprises an excess concrete evacuation mechanism at said excess concrete discharge location for evacuating excess concrete away from said screed of said auger, wherein said excess concrete evacuation mechanism comprises a transverse concrete conveyor carried by one of said screed and said handle member and located at said excess concrete discharge location for conveying excess concrete transversely upstream and away from said auger.

12. A portable concrete striking device as defined in claim 11, wherein said transverse concrete conveyor comprises a powered rotatable screw member disposed transversely to said auger for conveying the concrete transversely upstream and away from said auger.

13. A portable concrete striking device as defined in claim 12, wherein said excess concrete discharge location is located in-between and spaced from said first and second ends.

14. A portable concrete striking device as defined in claim 13, wherein said excess concrete discharge location is located centrally between said first and second ends.

15. A portable concrete striking device as defined in claim 14, wherein said rotatable screw member is carried by said auger and is operatively connected to a shaft of said auger to be rotated concurrently with said auger.

* * * * *